United States Patent [19]

Williams

[11] 4,032,225

[45] June 28, 1977

[54] COPYING MACHINES

[75] Inventor: Geoffrey C. Williams, Rochester, N.Y.

[73] Assignee: Rank Xerox Ltd., London, England

[22] Filed: Aug. 25, 1975

[21] Appl. No.: 607,644

[30] Foreign Application Priority Data

Sept. 24, 1974 United Kingdom .....4166/74

[52] U.S. Cl. ..... 355/3 DD; 355/14

[51] Int. Cl.[2] ..... G03G 15/00

[58] Field of Search ..... 355/3 DD, 14; 95/89 AR

[56] References Cited

UNITED STATES PATENTS

| | | | |
|---|---|---|---|
| 3,354,802 | 11/1967 | Doucette et al. | 95/89 AR |
| 3,561,344 | 2/1971 | Frutiger et al. | 95/89 AR |
| 3,656,509 | 4/1972 | Yasu | 355/10 X |
| 3,912,388 | 10/1975 | Takahashi et al. | 355/3 DD |

*Primary Examiner*—George H. Miller, Jr.
*Attorney, Agent, or Firm*—Earl T. Reichert

[57] ABSTRACT

An electrostatic copying machine having (1) a xerographic surface on which a latent electrostatic image is formed, (2) a developing station for developing the latent image by contacting the latter with developer material, and (3) a transfer station for transferring the developed image to support material, has a developer material replenishment device which replenishes developer material in the developing station in accordance with the amount of support material fed to the transfer station.

1 Claim, 3 Drawing Figures

COPYING MACHINES

BACKGROUND OF THE INVENTION

This invention relates to electrostatic copying machines, in which a latent electrostatic image is developed with developer particles and transferred to a sheet or web of support material.

Many coping machines have provided automatic devices for replenishing the developer material so that the standard of development of the images will not decrease while the machine is being used. This automatic replenishment has usually taken place at intervals while the machine is in operation, although more sophisticated machines such as that described in British patent specification No. 1 186 775 only replenish the developer material when its density is sensed by optical means to have fallen below a predetermined value.

The simple form of developer replenishment, which operates while the machine is in operation suffers from the disadvantage that the machine is in operation for a shorter time per copy produced when multiple copies of a single original are being made, than when a single copy of an original is being made because the time taken in starting up the machine and shutting it down before and after a copying run only occurs once, no matter how many copies are made during the run. If the developer replenishment is set to provide enough developer during the production of multiple copies of a single original, single copies made will tend to be over-developed since the machine will be in operation longer per copy during this mode of operation.

BRIEF SUMMARY OF THE INVENTION

According to the present invention, there is provided an electrostatic copying machine comprising means to produce a latent electrostatic image, means to develop the latent electrostatic image, means to transfer the developed image to support material, means to feed support material to receive the developed image, and a developer replenishment device responsive to the support material feeding means so as to supply replenishing developer material in accordance with the amount of support material fed to the transfer means.

BRIEF DESCRIPTION OF THE DRAWINGS

An example of the invention will now be described with reference to the accompanying drawings in which.

DETAILED DESCRIPTION OF THE INVENTION

Figure 1:
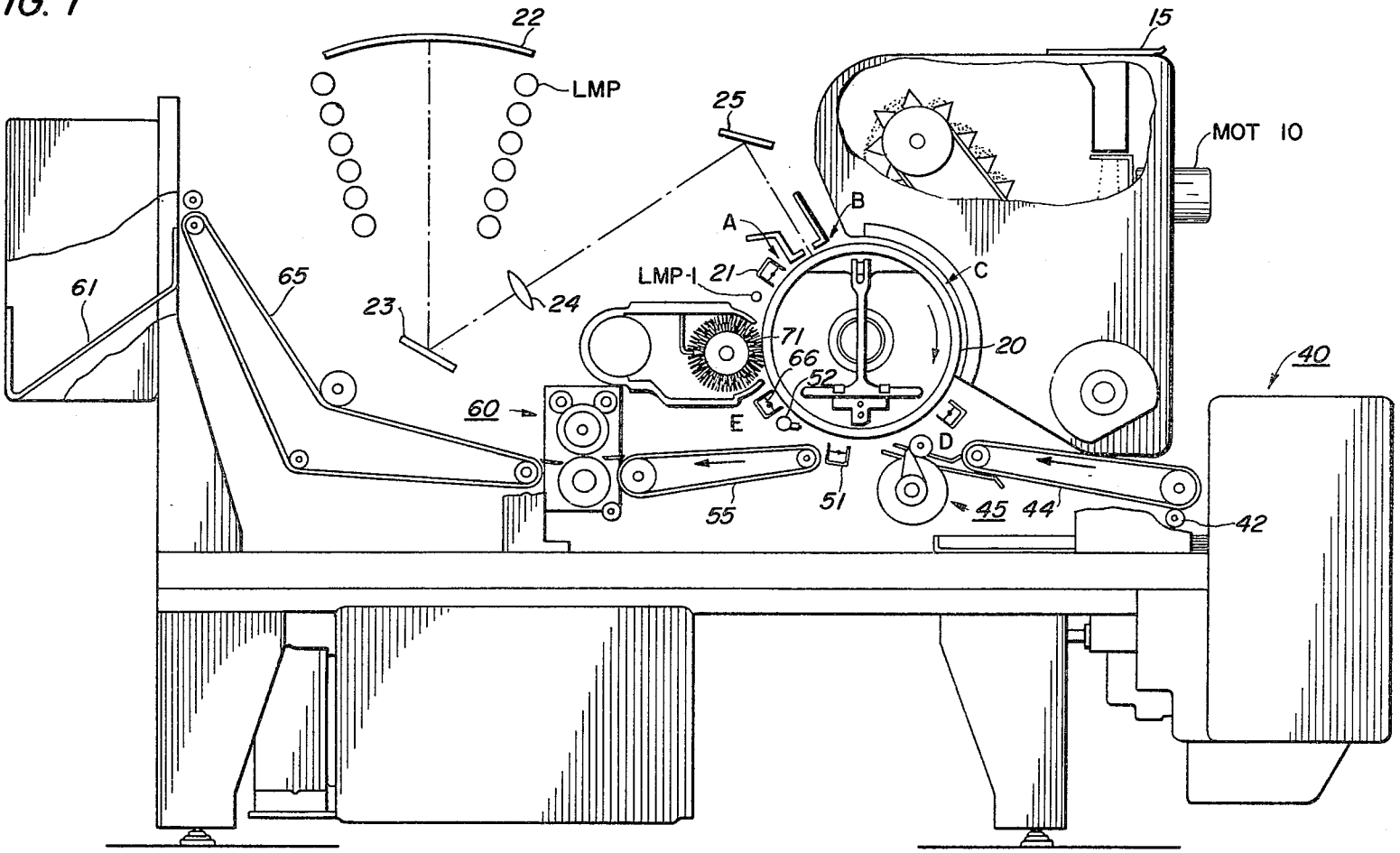
FIG. 1 is a schematic diagram of a xerographic copying machine.

In FIG. 1, an electrostatographic surface in the form of a xerographic drum 20 rotates in turn through a charging station A at which a uniform charge is applied by means of a corona discharge device 21 through an exposure station B at which a flowing light image is projected by means of an oscillating plane mirror 23, a fixed lens 24 and a fixed plane mirror 25 from a document placed face downwards on a curved platen 22 and illuminated by lamps LMP. The flowing light image creates a latent electrostatic image from the uniform charge applied by the device 21 and this is developed at the developing station C by two component developer material which is caused to cascade over the drum surface. The developed image on the drum passes to the transfer station D at the bottom of the drum at which a sheet of paper fed on a supply 40 by a conveyor 44 and drive roller 45 is fed into contact with the drum surface and moves the same peripheral speed. Transfer of the toner powder is achieved by a corona discharge device 51, after which the paper is stripped from the drum by a puffer 52 and transported by a further conveyor 55 to a fuser 60 and thence by a conveyor 65 to an out put tray 61. The drum surface, after leaving the transfer station passes a cleaning station E which includes a corona pre-cleaning device 66, a rotating brush 71 and a discharge lamp LMP 1. The drum then passes through the processing stations a second time.

The developing station contains a reservoir 15 of developer from the base of which developer material is metered into the path of the developer which cascades over the image under the control of a motor MOT 10.

Figure 2:
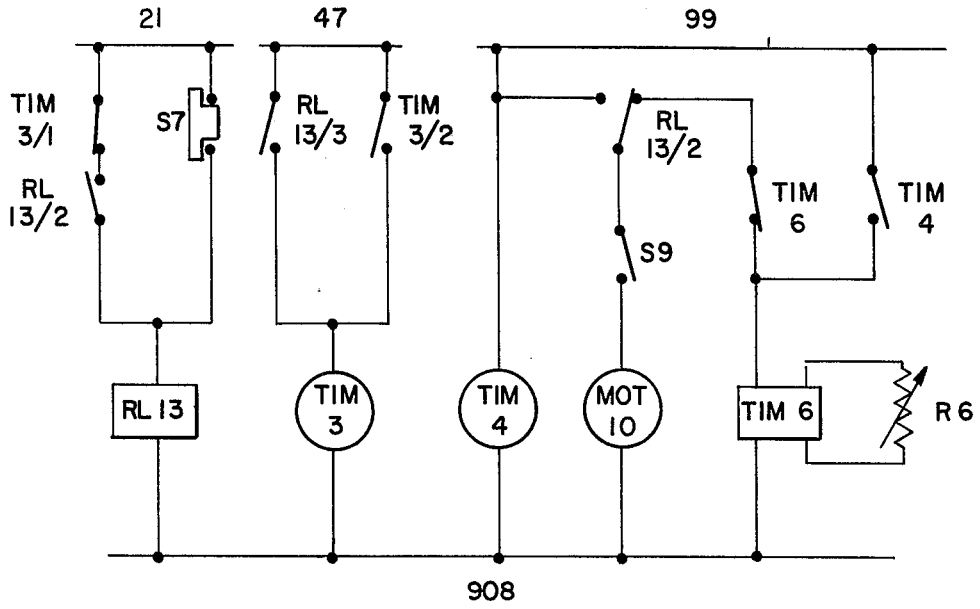
FIG. 2 PRIOR ART
FIG. 2 is a circuit diagram of the developer replenishment control system for use with the apparatus of FIG. 1, according to the prior art.

In prior art devices, the motor MOT 10 has been controlled by a system responsive only to the machine being switched on. Such a control circuit is illustrated in FIG. 2. A motor driven timer TIM 4 is connected between lines 99 and 908, and causes its contacts TIM 4 to close for a 10 second period each minute. The contact TIM 4 is connected in series with a timer TIM 6 between the lines 99 and 908, and a variable resistor R6 is connected to the timer TIM 6 to control the period after which its contact TIM 6 is opened between 0.3 and 5.0 seconds. The contact TIM 6 is connected in series with MOT 10 a relay contact RL 13/2, a switch S9 and the motor MOT 10 between lines 99 and 908. S9 is provided to isolate MOT 10 when no toner replenishment is desired.

When the machine is switched on, power is applied between lines 99 and 908 so that timer TIM 4 is continuously energised and its contact TIM 4 will close for 10 seconds each minute. During the closure of TIM 4, the timer TIM 6 will be energized, so that during the delay controlled by the resistor R6 the developer replenishment motor MOT 10 will be energized through TIM 4, TIM 6, 13/2 and S9 to cause toner to be fed from the reservoir 15 into the circulating developer system. At the end of its 10 second closed period contact TIM 4 will open thus resetting timer TIM 6 so that it contacts TIM 6 will be closed ready to energize MOT 10 again when the contact TIM 4 closes again at the end of the 50 second off period of timer TIM 4.

Figure 3:
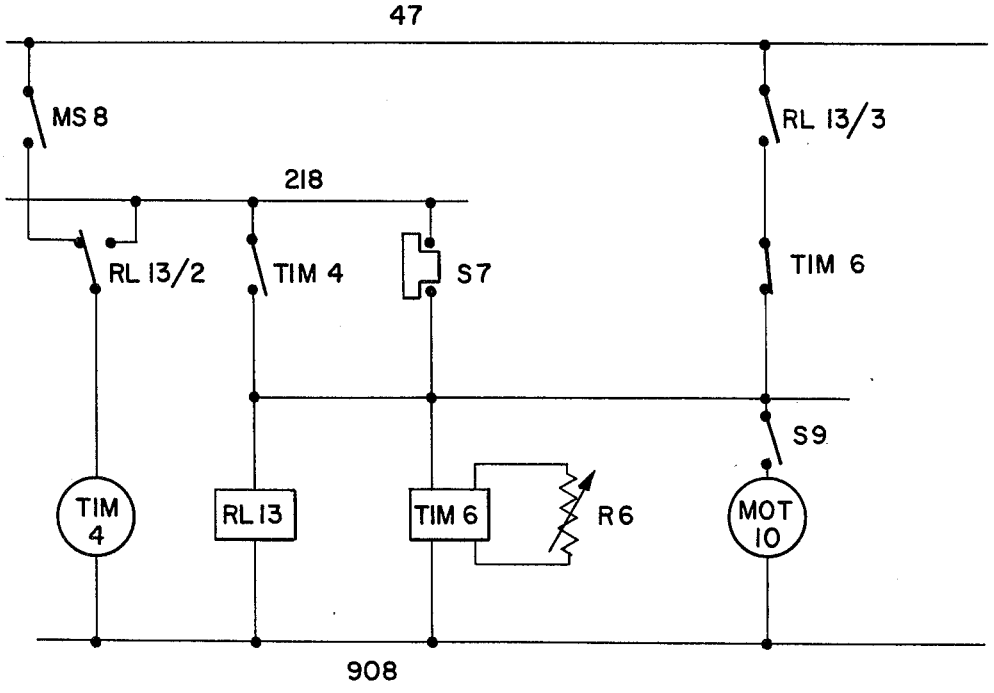
FIG. 3 is a circuit diagram of the developer replenishment control system according to the present invention.

In FIG. 3, the motor MOT 10 and the switch S9 in series, the timer TIM 6 and the relay RL 13 are connected as three parallel arms. These arms can be energised either from power line 218 through the normally open contact TIM 4 of the timer TIM 4 or through the normally closed contact TIM 6 of the timer TIM 6 and the normally open contact RL 13/3 of the relay RL 13 from the power line 47. The timer TIM 4 is normally energized by the closing of microswitch MS 8 connecting it to the power line 47 through the contact RL 13/2 in its normal position, but on energization of relay RL 13, the energization of TIM 4 is made from line 218. The microswitch MS 8 closes for 800 micro seconds for the passage of each sheet of paper to the transfer station of the copying machine, the contact TIM 4 closes for 500 milli seconds for each 15 seconds of operation of the timer TIM 4, and the contact TIM 6 will open after the timer TIM 6 has been energized for a time between 0.3 and 5.0 seconds, according to the set value of resistor R 6.

While the contact TIM 4 is open, the timer TIM 4 is driven for 800 milli seconds on the passage of each sheet towards the transfer station. When the timer TIM 4 is driven such that its contact TIM 4 closes, relay RL 13 is energized so that the energization of TIM 4 is now from line 218 through the switch contact RL 13/2, and power is applied to the motor MOT 10 from line 218 to contact TIM 4 and from line 47 through contact RL 13/3 and TIM 6. Timer TIM 4 and the motor MOT 10 will continue to be driven until both contact TIM 6 and TIM 4 open, which will be after a period of 500 milli seconds or the set period of the timer TIM 6, which ever is the longer. Relay RL 13 will then be de-energized, so that the circuit reverts to its quiescent state until contact TIM 4 is again closed. If the period during which contact TIM 6 is closed exceeds 500 milli seconds, the time during which timer TIM 4 must be driven by successive closures of microswitch MS 8 until contact TIM 4 closes again will be less than 14½ seconds by the excess period. The number of sheets which have to pass before the next energization of the motor MOT 10 will thus vary between 13 and 19.

Switch S 7 is provided to give a manual control of the toner replenishment, being connected in parallel with the contact TIM 4 in FIG. 3. A momentary closure of switch S 7 will cause the energisation of motor MOT 10 and the driving of timer TIM 4 for the period set by the timer TIM 6, since the closure of switch S 7 will cause relay RL 13 to be energised from line 218, thus actuating its contacts RL 13/2 and 13/3. If the driving of timer TIM 4 is such that its contact TIM 4 is closed at the end of the period of closure of the contact TIM 6, energization of the motor MOT 10 will continue until contact TIM 4 opens again. A similar manual control is provided in FIG. 2, depression of S 7 causing energization of RL 13 whose contact RL 13/2 energizes MOT 10 independent of TIM 4. RL 13 is kept energized for 13 seconds by timer TIM 3 which is energized by RL 13/3. RL 13/1 acts as a hold contact for RL 13 after S7 has been released until TIM 3/1 opens. TIM 3/2 keeps TIM 3 energized until the machine switches off so that TIM 3/1 remains open after the one manual operation.

What we claim is:

1. An electrostatic copying machine comprising means for producing an electrostatic latent image, means for developing the latent image, means for transferring the developed image to support material, means for feeding sheets of support material to the transfer means, and means responsive to the feeding means for replenishing developer material in accordance with the number of sheets fed to the transfer means, the replenishing means including:

a. a motor for controlling the flow of developer material from a reservoir;

b. detection means actuatable for a first predetermined period on the feeding of each sheet to the transfer means;

c. first relay means having a normally open first switch in series with the motor;

d. means for actuating the first relay means after the detection means has been actuated a given number of the first predetermined periods to close the first switch for a second predetermined time;

e. a normally closed second switch in series with both the motor and the first switch; and f. means responsive to the closing of the first switch for opening the second switch after a third predetermined time has elapsed.

* * * * *